US008316814B2

(12) United States Patent
Buck

(10) Patent No.: US 8,316,814 B2
(45) Date of Patent: Nov. 27, 2012

(54) TOPLOADING INTERNAL COMBUSTION ENGINE

(76) Inventor: Kenneth M. Buck, Winterville, NC (US)

( * ) Notice: Subject to any disclaimer, the term of this patent is extended or adjusted under 35 U.S.C. 154(b) by 707 days.

(21) Appl. No.: 12/493,551

(22) Filed: Jun. 29, 2009

(65) Prior Publication Data

US 2010/0325886 A1 Dec. 30, 2010

(51) Int. Cl.
*F02B 75/22* (2006.01)

(52) U.S. Cl. ..... 123/195 R; 123/54.4; 123/90.31

(58) Field of Classification Search ..... 123/54.4–54.8, 123/90.1, 90.38, 195 R, 195 P, 193.1–193.6, 123/90.27, 90.31, 90.39; 384/428, 430, 432, 384/433

See application file for complete search history.

(56) References Cited

U.S. PATENT DOCUMENTS 632,950 A 9/1899 Spence
898,678 A 9/1908 Piggins
900,083 A 10/1908 Clark
904,562 A 11/1908 Rathbun
1,145,995 A 7/1915 Johnson
1,163,671 A 12/1915 Kraus
1,260,847 A 3/1918 Winton
1,291,313 A * 1/1919 Weiss ..... 384/433
1,408,179 A 2/1922 Du Pont
1,433,821 A * 10/1922 Hull ..... 123/195 R
1,622,965 A 3/1927 Napier et al.
1,624,497 A 4/1927 McAllister
1,814,676 A 7/1931 Estep
1,850,246 A 3/1932 Simmen
1,906,765 A 5/1933 Purkey
2,199,423 A 5/1940 Taylor
2,423,602 A 7/1947 Magdeburger
2,455,493 A 12/1948 Jacobs
2,491,630 A 12/1949 Voorhies
2,712,483 A 7/1955 Ciaccia
2,793,625 A * 5/1957 Kolbe ..... 92/149
2,858,667 A 11/1958 Reske
3,136,306 A 6/1964 Kamm
3,169,365 A 2/1965 Benjamen
3,398,653 A 8/1968 Foster
3,946,697 A 3/1976 Hackbarth et al.
4,015,908 A 4/1977 Ashley
4,029,071 A 6/1977 Saito et al.
4,033,016 A 7/1977 Mayer
4,041,919 A 8/1977 Bonin
4,054,108 A * 10/1977 Gill ..... 123/54.4
4,068,612 A 1/1978 Meiners
4,133,284 A 1/1979 Holcroft (Continued)

OTHER PUBLICATIONS

Lee, Yi-Kuen; Yi, Ui-Cong; Tseng, Fan-Gang; Kim, Chang-Jin "CJ"; Ho, Chih-Ming, "Fuel Injection by a Thermal Microinjector", Mechanical and Aerospace Engineering Department; University of California, Los Angeles, CA; cjkim@seas.ucla.edu.

(Continued)

*Primary Examiner* — Noah Kamen
*Assistant Examiner* — Hung Q Nguyen
(74) *Attorney, Agent, or Firm* — Jerome R. Drouillard

(57) ABSTRACT

An internal combustion engine includes a carrier base having a lower portion configured as a crankcase and an upper portion having a number of upwardly directed assembly provisions such as a crankshaft bay and at least one cylinder deck, with the crankshaft bay and cylinder deck being arranged so that the engine may be assembled from a position above the engine, without the necessity of attaching connecting rods or crankshaft main bearing bolts from underneath the engine.

6 Claims, 4 Drawing Sheets

U.S. PATENT DOCUMENTS 4,135,478 A * 1/1979 Rassey ..... 123/58.1
4,179,884 A 12/1979 Koeslin
4,187,678 A 2/1980 Herenius
4,198,947 A * 4/1980 Rassey ..... 123/54.7
4,214,443 A 7/1980 Herenius
4,220,121 A 9/1980 Maggiorana
4,268,042 A 5/1981 Borlan
4,286,931 A 9/1981 Hafele et al.
4,306,614 A 12/1981 Maggiorana
4,308,834 A 1/1982 Eheim
4,348,991 A 9/1982 Stang et al.
4,385,594 A 5/1983 Hauser, Jr.
4,437,444 A 3/1984 Yasuhara
4,449,503 A 5/1984 Luscomb
4,459,945 A 7/1984 Chatfield
4,490,098 A 12/1984 Freudenschuss et al.
4,497,298 A 2/1985 Ament
4,534,241 A 8/1985 Remmerfelt et al.
4,535,592 A 8/1985 Zinsmeyer
4,539,956 A 9/1985 Hengel et al.
4,562,697 A 1/1986 Lawson
4,565,175 A 1/1986 Kaye
4,596,179 A 6/1986 Bando
4,621,594 A 11/1986 Kubis
4,622,864 A 11/1986 Fetouh
4,699,112 A 10/1987 Filippi et al.
4,700,047 A 10/1987 Crossett et al.
4,704,949 A 11/1987 Foster
4,711,088 A 12/1987 Berchem et al.
4,712,985 A 12/1987 Wakasa et al.
4,742,801 A 5/1988 Kelgard
4,759,181 A 7/1988 Biritz
4,763,619 A 8/1988 Eitel
4,790,731 A 12/1988 Freudenschuss
4,807,577 A 2/1989 Koutsoupidis
4,819,606 A 4/1989 Kawano
4,861,243 A 8/1989 Wade
4,873,947 A 10/1989 Ryan, III et al.
4,884,542 A 12/1989 Konrath et al.
4,913,115 A 4/1990 Konrath et al.
4,928,656 A 5/1990 Ausiello
4,961,404 A 10/1990 Itakura et al.
4,968,220 A 11/1990 Filippi et al.
5,004,042 A 4/1991 McMorries, IV et al.
5,014,572 A 5/1991 Swars
5,060,606 A 10/1991 Hubbard
5,072,706 A 12/1991 Eblen et al.
5,095,861 A 3/1992 Dove, Jr.
RE33,870 E 4/1992 Fittro et al.
5,115,771 A 5/1992 Ozawa
5,148,675 A 9/1992 Inman
5,197,188 A 3/1993 Maus et al.
5,209,208 A 5/1993 Siebert et al.
5,303,468 A 4/1994 Cieszkiewicz et al.
5,316,079 A 5/1994 Hedeen
5,327,858 A 7/1994 Hausknecht
5,394,854 A 3/1995 Edmaier et al.
5,415,147 A 5/1995 Nagle et al.
5,433,178 A 7/1995 Urmaza
5,463,867 A 11/1995 Ruetz
5,551,234 A 9/1996 Ochoizki
5,577,470 A 11/1996 Leydorf, Jr. et al.
5,706,675 A 1/1998 Manikowski, Jr.
5,730,093 A 3/1998 Calka et al.
5,732,665 A 3/1998 Morrison
5,732,670 A 3/1998 Mote, Sr.
5,746,270 A 5/1998 Schroeder et al.
5,813,372 A 9/1998 Manthey
5,832,991 A 11/1998 Cesaroni
6,006,730 A 12/1999 Rutke et al.
6,009,850 A 1/2000 DeLuca
6,016,790 A 1/2000 Makino et al.
6,027,312 A 2/2000 Djordjevic
6,073,862 A 6/2000 Touchette et al.
6,098,576 A 8/2000 Nowak, Jr. et al.
6,116,026 A 9/2000 Freese
6,123,144 A 9/2000 Morman et al.
6,178,936 B1 1/2001 Kouchi et al.
6,182,643 B1 2/2001 Canopy
6,196,181 B1 3/2001 Pong
6,227,156 B1 5/2001 Autrey et al.
6,230,676 B1 5/2001 Pryba et al.
6,230,683 B1 5/2001 zur Loye et al.
6,237,554 B1 5/2001 Garrison
6,244,231 B1 6/2001 Kouchi et al.
6,293,335 B1 9/2001 Tawney et al.
6,343,576 B1 2/2002 Ogata et al.
6,347,618 B1 2/2002 Klem
6,357,401 B1 3/2002 Moriyama et al.
6,357,407 B2 3/2002 Brothers
6,360,532 B2 3/2002 Strahle et al.
6,360,728 B1 3/2002 Sturman
6,378,299 B1 4/2002 Schlehuber
6,378,396 B1 4/2002 Reinhardt et al.
6,408,803 B1 6/2002 Atkins
6,415,754 B1 7/2002 Hirano et al.
6,457,442 B1 10/2002 Fuchs et al.
6,484,683 B2 11/2002 Zielke
6,543,405 B2 * 4/2003 Sachdev et al. ..... 123/195 R
6,604,515 B2 8/2003 Marsh et al.
6,640,773 B2 11/2003 Ancimer et al.
6,640,775 B2 11/2003 Itoyama et al.
6,651,618 B1 11/2003 Coleman et al.
6,672,989 B2 1/2004 Murata et al.
6,694,945 B2 2/2004 Kawaguchi et al.
6,698,509 B2 3/2004 Rong
6,725,815 B2 4/2004 Cannata
6,729,133 B1 5/2004 Sorter et al.
6,739,293 B2 5/2004 Turner et al.
6,748,906 B1 6/2004 White et al.
6,748,934 B2 6/2004 Natkin et al.
6,755,176 B2 6/2004 Takeuchi et al.
6,758,193 B1 7/2004 Kincaid
6,823,833 B2 11/2004 Ismailov
6,840,209 B2 1/2005 Shimazaki
6,840,211 B2 1/2005 Takahashi
6,840,219 B2 1/2005 Joos et al.
6,840,220 B2 1/2005 Yomogida et al.
6,845,747 B2 1/2005 Rasmussen et al.
6,845,754 B2 1/2005 Pecheny et al.
6,845,757 B2 1/2005 Strahberger et al.
6,941,914 B2 9/2005 Snyder et al.
7,146,724 B2 * 12/2006 Millerman ..... 29/888.01
2006/0005797 A1 1/2006 Schubeck

OTHER PUBLICATIONS

Seatek 600-PLUS 6 Cylinder, Marine Diesel Engine; Feb. 10, 2005; http://boatdiesel.com/Engines/.

* cited by examiner

TOPLOADING INTERNAL COMBUSTION ENGINE

BACKGROUND OF THE INVENTION

1. Field of the Invention

The present invention relates to a multicylinder internal combustion engine which may be assembled from the top side of the engine without the need for accessing internal parts through a lower portion of the engine.

2. Related Art

Reciprocating internal combustion engines utilizing a crankshaft upon which a number of pistons and connecting rods are mounted typically require that assembly of the engine proceed with operations accessed from not only the top portion of the engine, but also the lower portion of the engine. Thus, when mounting a crankshaft within a conventional internal combustion engine, a cylinder block must be accessed from a lower portion of the engine, so as to allow the crankshaft to be placed into contact with the block, and secured with main bearing caps placed from underneath the engine. Then, pistons and connecting rods are inserted from the top of the engine; once again the fastenings for the connecting rod caps must be applied from underneath the engine. This assembly technique causes unfortunate problems in the context of many usages of internal combustion engines. For example, in marine usage, it is often very difficult to obtain access to the lower portion of an engine once it has been installed in a vessel. Similarly, with many vehicle usages and even stationary usage of reciprocating engines, access to the lower portion of the crankcase is difficult, which makes it extremely difficult to work on the engine in place. This, in turn, frequently necessitates expensive and time-consuming removal of the engine to allow it to be properly serviced. Moreover, known internal combustion engines which have suffered spun main bearings or other bearing damage often require expensive and technically difficult resurfacing of the main bearing bores. And, extensive damage in the area of the main bearing bores often necessitates the scrapping of motor blocks, at concomitantly high expense.

It would be desirable to provide an internal combustion engine assembled almost completely from the top of the engine, while at the same time offering completely renewable main bearing bores, so as to avoid both the need to resurface main bearing bores in the field, as well as the scrapping of engines having heavily damaged main bearing bores.

SUMMARY OF THE INVENTION

According to an aspect of the present invention, an internal combustion engine includes a carrier base having a lower portion configured as a crankcase, and an upper portion having a number of upwardly-directed assembly provisions. A crankshaft is mounted within an upward-opening crankshaft bay of the carrier base. The engine also includes a number of main bearing caps for mounting the crankshaft within the crankshaft bay, and a camshaft carrier mounted upon the main bearing caps. According to another aspect of the present invention, a camshaft is journaled within the camshaft carrier, which further houses a number of valve lifters which are reciprocally housed within the camshaft carrier.

According to another aspect of the present invention, a number of cylinder assemblies are mounted to at least one cylinder deck adjoining the crankshaft bay at the upper portion of the carrier base. The engine also includes a number of piston and connecting rod assemblies, with the connecting rods being attached to the crankshaft and to the pistons, and with the pistons being housed within the cylinder assemblies.

According to another aspect of the present invention, a number of lower bearing sections are secured to the carrier base within the crankshaft bay, with the lower bearing sections cooperating with a number of main bearing caps, also secured to the carrier base within the crankshaft bay, to mount the crankshaft within the crankshaft bay.

According to another aspect of the present invention, a method for topload assembly of an internal combustion engine includes providing a carrier base having a lower portion configured as a crankcase, and an upper portion configured with a number of assembly provisions, and mounting a crankshaft within a crankshaft bay located within the upper portion of the carrier base, with the crankshaft being secured by a number of main bearing caps.

According to another aspect of the present invention, a method for topload assembly of an internal combustion engine further includes mounting a camshaft carrier in the upper portion of the engine upon the main bearing caps, and mounting a number of cylinder assemblies upon cylinder decks located upon the upper portion of the carrier base adjoining the crankshaft bay. Before the cylinder assemblies are mounted to the cylinder decks, pistons and connecting rods will first be attached to the engine's crankshaft through an upper portion of the carrier base.

It is an advantage of a method and system according to the present invention that an internal combustion engine may be assembled and disassembled from the top side of the engine, without the need for performing any significant operations below the crankshaft.

It is yet another advantage of a method and system according to the present invention that the engine may be installed in a more compact space, due to the absence of a need to access the lower portion of the engine in the event that work must be performed on the engine's power cylinders.

Other advantages, as well as features of the present invention, will become apparent to the reader of this specification.

DETAILED DESCRIPTION OF THE PREFERRED EMBODIMENTS

Figure 1:
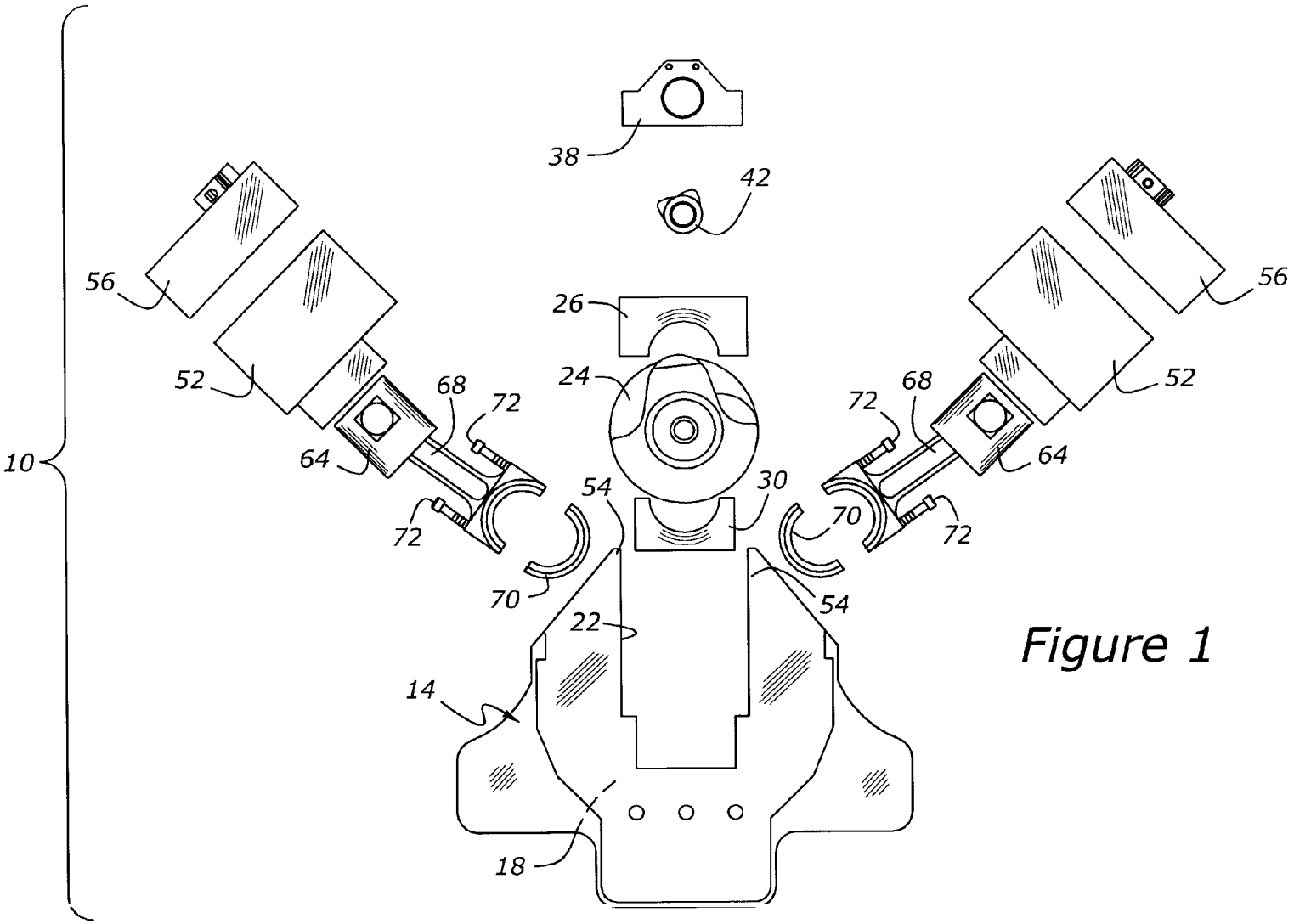
FIG. 1 is an exploded view of a top-loading internal combustion engine according to an aspect of the present invention.
Figure 2:
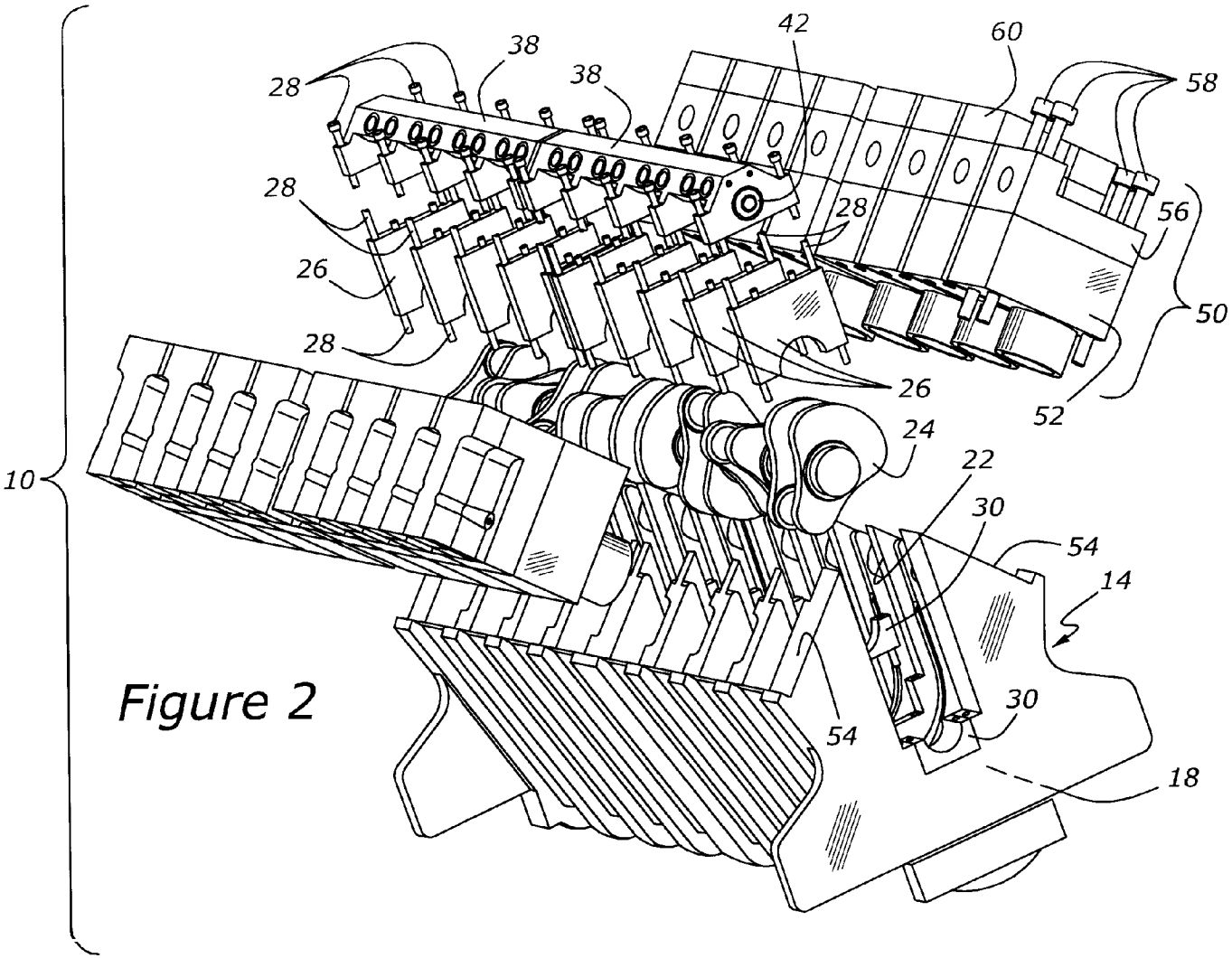
FIG. 2 is a second exploded perspective view of a top-loading internal combustion engine according to the present invention.
Figure 4:
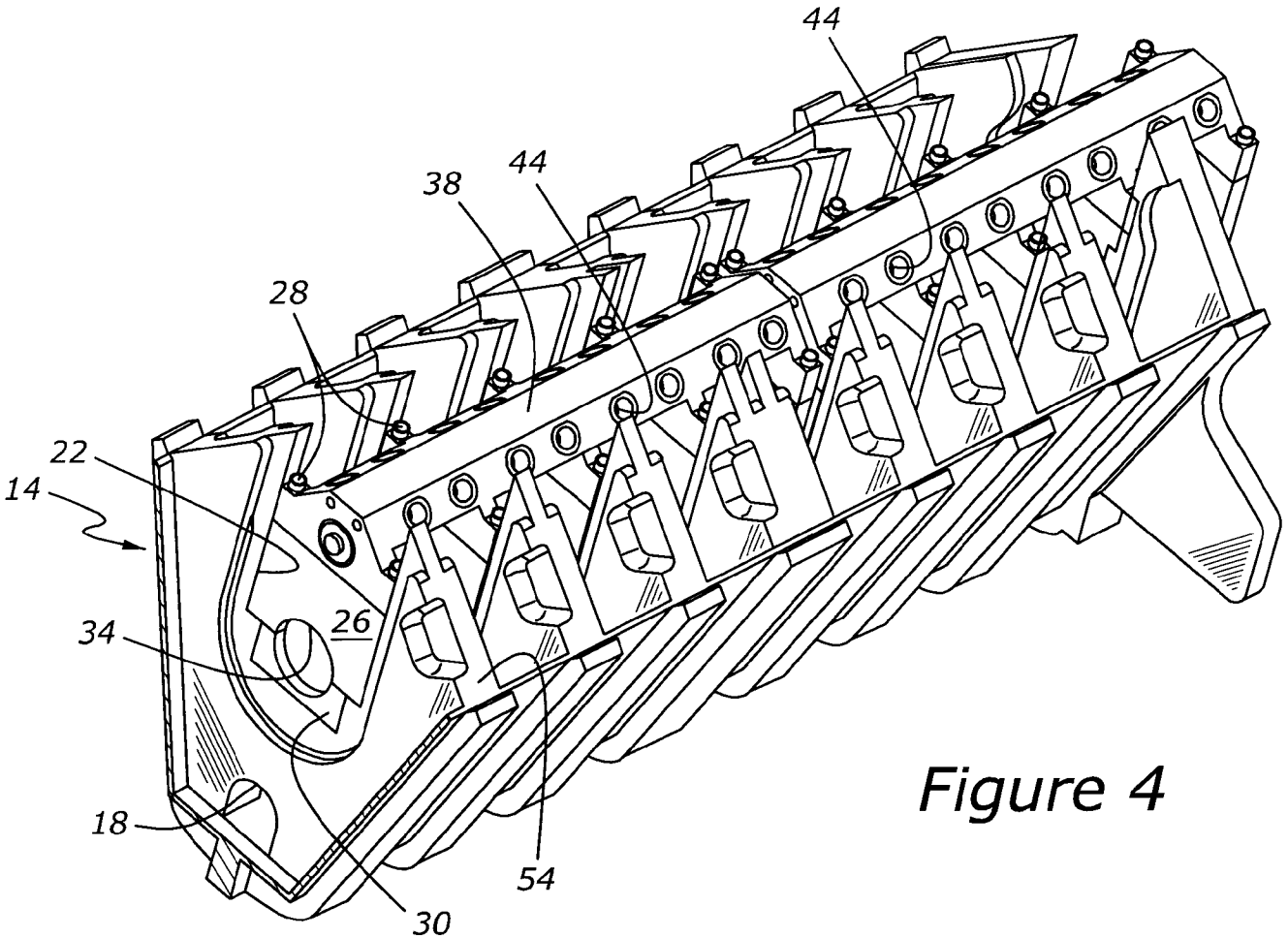
FIG. 4 is a perspective view of an assembled cylinder block according to an aspect of the present invention.

As shown in FIGS. 1 and 2, engine 10 is assembled into the upper portion of a carrier base, 14. Carrier base 14 has a lower portion configured as a crankcase, 18, and an upper portion having a number of upwardly directed assembly provisions, such as crankshaft bay 22 (FIGS. 2 and 4). During assembly of engine 10, crankshaft 24 is bedded into crankshaft bay 22 of carrier base 14 by first installing a number of lower bearing sections, 30, which are shown in FIGS. 1, 2 and 4. Bearing sections 30 may be secured by recessed cap screws (not shown) or alternatively, they may be configured to slide and lock into grooved portions of crankshaft bay 22. Once lower bearing sections 30 have been installed in crankshaft bay 22, along with an appropriate bearing insert (not shown), crankshaft 24 may be lowered into place and then secured with a number of main bearing caps 26. Main bearing caps 26 are secured with cap screws 28, which also serve to mount camshaft carrier 38 to the upper plane or upper surface of main bearing caps 26. Both cam carrier 38 and main bearing caps 26 are held in place within crankshaft bay 22 by a number of cap screws 28.

After crankshaft 24 has been mounted within carrier base 14, piston and connecting rod assemblies may be attached to crankshaft 24. Pistons 64 are mounted upon connecting rods 68. Each of connecting rods 68 has two bolts, 72, (FIG. 1), which are attached from the top of engine 10, through an upper portion of carrier base 14, into connecting rod caps 70, so as to attach connecting rods 68 and pistons 64 to crankshaft 24. After pistons 64 and connecting rods 68 have been attached to crankshaft 24, each of the individual cylinder assemblies, 50, may be installed. This begins with the sliding engagement of cylinders 52 with their respective pistons 64 and cylinder decks 54. After cylinders 52 are placed into contact with cylinder decks 54, cylinder heads 56 will be secured to cylinders 52 with cap screws, 58, extending through cylinder heads 56 and cylinders 52 and through cylinder decks 54 into the structure of carrier base 14. Rocker covers 60 are then mounted to cylinder heads 56.

Figure 3:
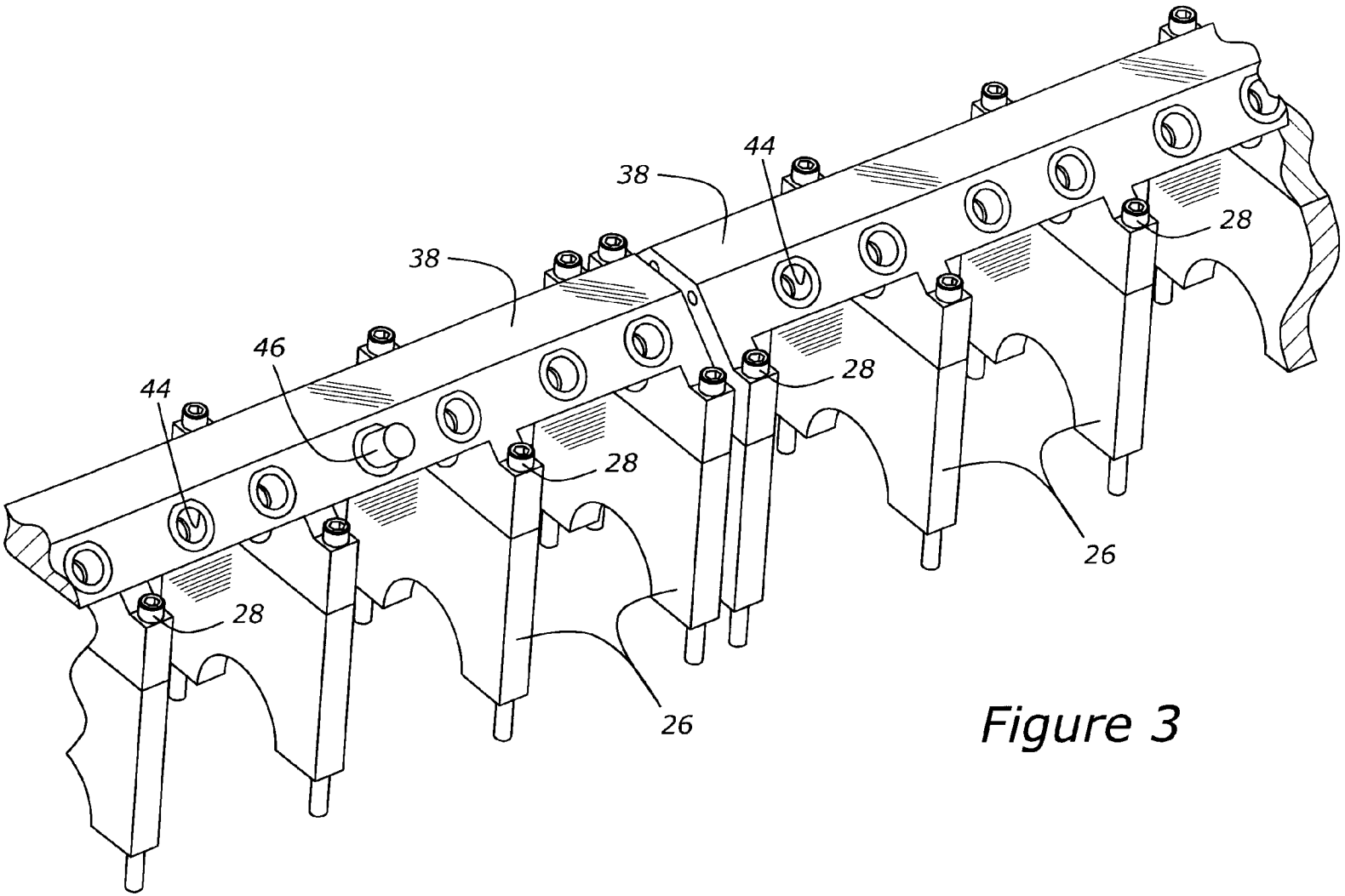
FIG. 3 is a perspective view of a camshaft carrier and also showing main bearing caps according to an aspect of the present invention.

FIG. 3 shows additional details of main bearing caps 26, cap screws 28, and camshaft carriers 38. It is noted, too, that lifter bores 44 are formed in camshaft carrier 38 for the purpose of housing valve lifters such as that shown as item 46. Camshaft 42 is journaled upon a number of bearings (not shown) which are contained within camshaft carriers 38. Although two separate camshaft carriers 38 are shown, a single, longer, carrier 38 may be employed.

FIG. 4 shows an assembled cylinder block according to an aspect of the present invention. Cap screws 28, which are used to retain crankshaft 24 are shown, as are main bearing caps 26 and lower bearing sections 30, which taken together, form main bearing bores 34. It is seen from FIG. 4 that if a main bearing bore 34 becomes damaged due to a spun bearing, for example, replacement of main bearing caps 26 and lower bearing sections 30 will completely renew bearing bore 34, without the need for onsite machining, or for that matter, scrapping of carrier base 14.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A top-loading internal combustion engine, comprising:

a carrier base having a lower portion configured as a crankcase and an upper portion having a plurality of upwardly-directed assembly provisions;

a crankshaft mounted within an upward-opening crankshaft bay of said carrier base;

a plurality of main bearing caps for mounting said crankshaft within said crankshaft bay; and a camshaft carrier mounted upon said plurality of main bearing caps.

2. An internal combustion engine according to claim 1, further comprising a camshaft journaled within said camshaft carrier.

3. An internal combustion engine according to claim 1, further comprising a plurality of valve lifters reciprocally housed within said camshaft carrier.

4. An internal combustion engine according to claim 1, further comprising a plurality of cylinder assemblies mounted to at least one cylinder deck adjoining said crankshaft bay at said upper portion of said carrier base.

5. An internal combustion engine according to claim 1, further comprising a plurality of piston and connecting rod assemblies, with said connecting rods being attached to the crankshaft and to the pistons, and with the pistons being housed within said cylinder assemblies.

6. An internal combustion engine according to claim 1, further comprising a plurality of lower bearing sections secured to said carrier base within said crankshaft bay, and cooperating with a plurality of main bearing caps also secured to said carrier base within said crankshaft bay, to mount said crankshaft within the crankshaft bay.

* * * * *